United States Patent [19]

Precoul

[11] 4,436,033

[45] Mar. 13, 1984

[54] HOLLOW CHARGES WITH PLURAL CONICAL CONFIGURATIONS

[75] Inventor: Michel Precoul, Paris, France

[73] Assignee: Societe d'Etudes, de Realisations et d'Applications Techniques (SERAT), Paris, France

[21] Appl. No.: 287,547

[22] Filed: Jul. 28, 1981

[30] Foreign Application Priority Data

Aug. 6, 1980 [FR] France ..... 80 17341

[51] Int. Cl.[3] ..... F42B 1/02

[52] U.S. Cl. ..... 102/307; 102/310; 102/476

[58] Field of Search ..... 102/306–310, 102/476

[56] References Cited

FOREIGN PATENT DOCUMENTS 2007625 9/1971 Fed. Rep. of Germany .

*Primary Examiner*—Peter A. Nelson

*Attorney, Agent, or Firm*—Wenderoth, Lind & Ponack

[57] ABSTRACT

A hollow charge includes a covering having multiple sloped portions having apical angles which increase from back to front and create a multiple-stage effect or cascade effect.

18 Claims, 6 Drawing Figures

36
33c
37'''
h3
h2
37''
33b
h1
33
33a
37'
P'''
35
34
A
R2
R1
H
37
α3
d3
d2
α2
d1
α1
e3
e2
e1

25
26c
h3
h2
26b
M
h1
26a
29
30
31
32
A
H
26
27
24
28
α3
d3
d2
α2
d1
α1
e3
e2
e1

19
17c
17b
17
18
17a
21
22
23
20
A
h3
h2
h1
M
H
P'''
α3
d3
d2
α2
d1
α1
e3
e2
e1

HOLLOW CHARGES WITH PLURAL CONICAL CONFIGURATIONS

BACKGROUND OF THE INVENTION

Hollow charges known as "first generation" charges and developed during the 1950 decade, made use of a copper covering in the form of a "tulip" or having a "double slope", its thickness generally progressively increasing.

Priming took place at a central point and developed an arcuate wave. The explosive, usually hexolite, had a hexogen content of approximately 60%, obtained by decantation, and the charge was less concentrated towards the rear. This type of hollow charge represented an enormous advance compared with the previous materials (period 1938–1945). The penetrating power was thus increased from 0.5/1 calibre to 4 calibres.

The second generation (the 1960 decade) was directed towards conical coverings, still made of copper, having an angle of approximately 60°. The same explosive was used, but improved methods of charging enabled the hexogen content to be increased to more than 70%, its concentration being almost uniform from the base of the covering to the priming means.

An important feature of this second generation of hollow charges was the move towards finding means comprising a screen and producing a toroidal wave. The penetrating power then increased considerably once more and went from 4 to 5 calibres, or a little more than 5 calibres.

It is now required to effect a further advance, in particular by improving the effectiveness of the hollow charge against modern composite armour-plating which has a very considerable thickness whatever its composition and the nature of the various heterogenous layers that form each type of composite armour-plating. In this connection, any extension of the jet effect or other effect of the hollow charge can result in an increase in the end-effect.

The following French Patents in the name of the present applicant represent new and important advances as regards the end-effect:

| | |
|---|---|
| Pat. No. 75 14 091, of 6th May 1975<br>Pat. No. 77 35 320, of 24th November 1977<br>Pat. No. 76 28 964, of 27th September 1976 | "Double hollow charge" and "Charge consisting of coaxial annular layers" |

These are concerned in particular with improved methods of charging, on the one hand, and the structure or arrangement of the charge, on the other.

SUMMARY OF THE INVENTION

The present invention is aimed at improving the end effect of the hollow charge by intensifying the depth effect of the jet by using a covering having multiple slopes or sloped portions which are conical or frustoconical (three or more) so that, with a multiple hollow charge, a cascade effect or multiple effect can be achieved rather like the effect obtainable with a multiple-stage hollow charge. Thus, according to the invention, the double-stage effect, dealt with in the first two of the above-mentioned French patents in the name of the present Applicant, is intensified by increasing the number of stages.

The various features and advantages of the invention will emerge from the following description of a number of embodiments. However, it should be pointed out that these are merely examples and that other methods of construction, arrangements, shapes and proportions could also be used without departing from the ambit of the invention.

BRIEF DESCRIPTION OF THE DRAWINGS

In the course of this description, reference will be made to the attached drawings, wherein.

DETAILED DESCRIPTION OF THE INVENTION

The examples dealt with below relate to a covering comprising three slopes which produce the same number of effect stages.

Still within the ambit of the invention, the number of slopes may, of course, be other than three.

Figures 1, 2, 3:
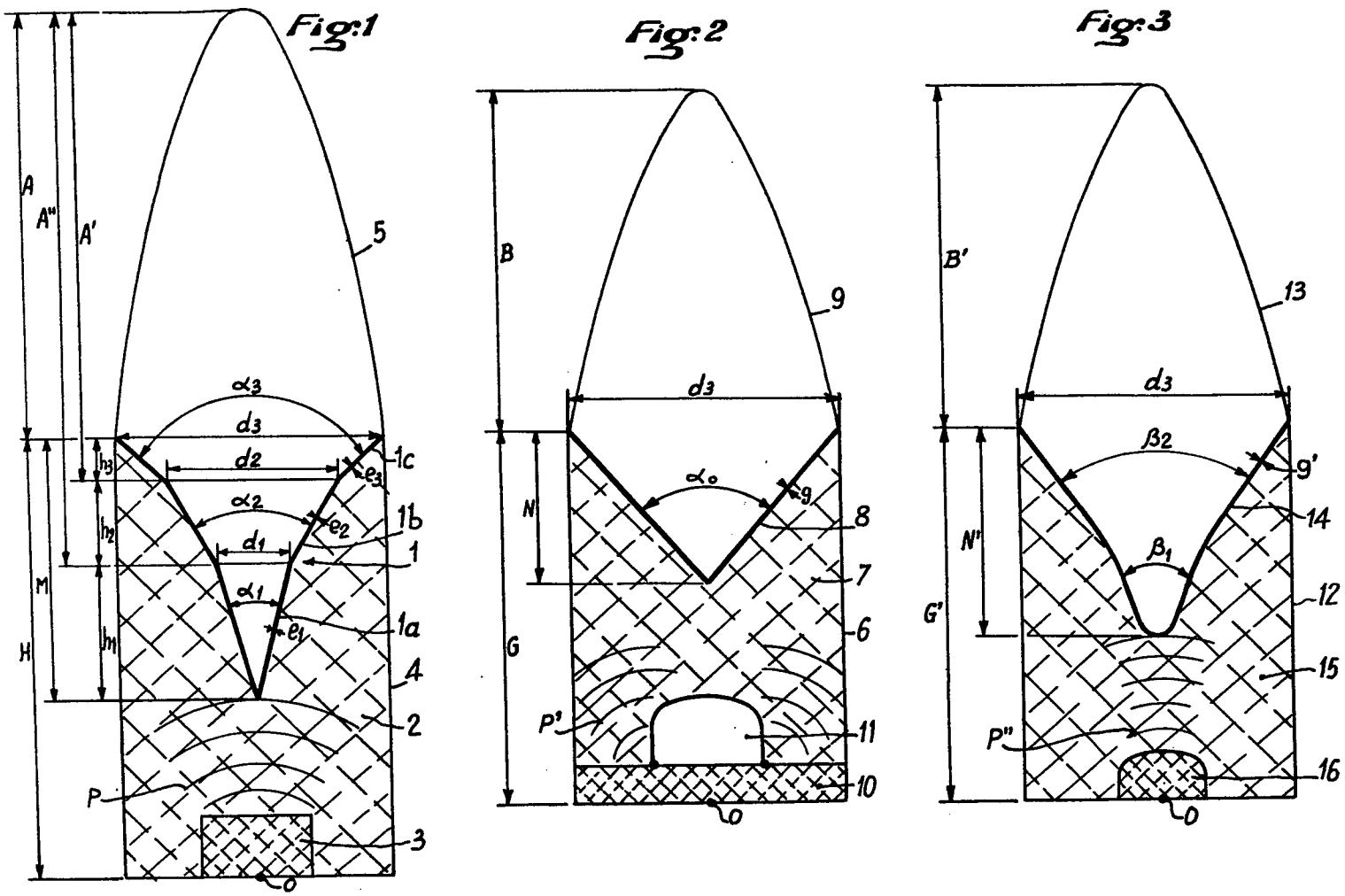
FIGS. 1, 4, 5 and 6 illustrate diagrammatically and in longitudinal axial section, hollow-charge heads in accordance with the invention.
FIGS. 2 and 3 illustrate, in views similar to the previous ones, hollow charges having a conventional covering, these views being intended to make the description clearer.

FIG. 1 illustrates a hollow-charge head in accordance with the invention. It comprises a covering 1 having three sloped stages (non-limitive), a main explosive 2 and a central priming means 3. The three stages are disposed sequentially from the rear end to the forward end of the covering. Each stage 1*a*, 1*b*, 1*c* has a conical or frustoconical configuration which converges toward the rear end of the covering and which defines with a plane extending through the longitudinal axis of the covering, i.e. the plane of FIG. 1, a pair of rectilinear slopes which converge toward the rear end of the covering.

The case 4 and the cap 5 complete the construction. The length of the head is $H+A$($A$=length of lead portion of the head, and $H$=depth of charge).

The covering 1 in accordance with the invention, having a total depth of $M \leqq H$, comprises three conical sloped stages or portions producing three effect stages. According to the invention, each of the slopes, in relation to the axis of the covering, is steeper at the lower end than at the top:

stage 1*a*—rear, angle $\alpha_1$, depth $h_1$, diameter at top $d_1$;

stage 1*b*—intermediate, angle $\alpha_2 \geqq \alpha_1$, depth $h_2$, diameter at top $d_2 \geqq d_1$;

stage 1*c*—top angle $\alpha_3 \geqq \alpha_2 \geqq \alpha_1$, depth $h_3$, diameter at top $d_3 \geqq d_2 \geqq d_1$ ($d_3$ approximates to the calibre of the projectile);

As will be apparent from FIG. 1, rectilinear extensions of the slopes of adjacent of the stages intersect.

It will be seen from FIG. 1 that $M=h_1+h_2+h_3$, and that the starting point O produces an arcuate wave P which impinges, in succession, upon the rear, intermediate and top stages, i.e. 1*a*, then 1*b*, then 1*c*.

According to the invention, the most rapid jet is the one produced by stage 1*a*, having an angle $\alpha_1 \leqq \alpha_2$; then follows the jet of stage 1*b*, having an angle $\alpha_2 \leqq \alpha_3$, and finally the jet of stage 1*c*, having an angle $\alpha_3$, this being the front and largest angle.

Thus, in accordance with the invention, an elongated jet is obtained by a suitably arranged succession of the jet portions of the multiple-slope covering which produce stage effects, the slope of the covering being greater at the bottom than at the top.

By means of the arrangements in accordance with the invention, the central priming means sets up an arcuate wave, which firstly impinges upon the stage or fraction having the gentlest slope (more acutely angled covering providing a more rapid jet), then the stage or fraction having a sharper slope (less rapid jet), and finally the stage or fraction having a still sharper slope (still less rapid jet).

This combination of effects makes it possible, using the multiple-slope covering of the invention, to obtain an elongated jet providing a greater penetration capacity and therefore an increased end-effect, particularly when operating against modern armour-plating of great thickness and comprising several heterogeneous layers of material.

Furthermore, the construction of a head of a multiple-slope covering in accordance with the invention is able to provide, in the case of a head having a length H+A and a length A of the leading portion, optimization of its effectiveness at each stage of the slope of the covering, by improving the "stand-off" of the stages of smaller diameter: A for the portion AV, having a diameter $d_3$, $A'=A+h_3$, for the intermediate portion having a diameter $d_2 \leqq d_3$, and $A''=A+h_2+h_3$, for the portion AR, having a diameter $d_1 \leqq d_2 \leqq d_3$.

Still within the framework of the invention, the multiple-slope covering may be of a thickness that is constant or varying. Thus, according to the invention, it may be of diminishing thickness $e_1 \geqq e_2 \geqq e_3$ (constant, for example, in each stage having a constant slope $\alpha_1 \leqq \alpha_2 \leqq \alpha_3$). Thus, according to the invention, an increase in weight of the fastest, rear, jet $(\alpha_1-e_1)$ is obtained, then a smaller increase in weight of the intermediate jet $(\alpha_2-e_2)$, and finally a still further reduction in the relative specific mass of the forward jet $(\alpha_3-e_3)$.

This variation in the thickness of the multiple-slope covering in relation to the magnitude of the slopes, and therefore to the specific velocity of the jet of the stage concerned, enables a still further improvement in the end-effect to be achieved by increasing the continuity of the jet and thus reducing, to a certain extent, the difference in velocity at each stage, but without sacrificing power. Since the arrangements in accordance with the invention increase the mass and reduce the velocity of the jet at the stage in question, they increase the weight of the jet and thus tend to retain the power of the fraction.

As indicated above, other arrangements affecting the thickness of the covering may be used still within the framework of the invention, the object always being that of creating the most continuous, longest and most powerful jet by using permutations of the various parameters.

To enable the invention to be more readily understood, FIG. 2 illustrates a modern conventional hollow charge having a case 6 and a cap 9, together with a main explosive charge 7, a conical covering 8 having an angle $\alpha_0$ and a thickness g (constant), as well as a priming means 10 comprising a screen 11, with a toroidal wave P' (centre of initiation 0) being developed.

The depth of the charge is G, the length of the leading end is B, the depth of the covering is N, and the calibre is $d_3$.

In general, $B \leqq A$, and $G \leqq H$ (FIG. 1).

It is therefore clear that the projectile (FIG. 1) in accordance with the invention is more elongated than a modern conventional projectile (FIG. 2), as regards the length of the leading portion ($A \geqq B$), so as to make the best of the successive jets of the multiple-slope covering, and also as regards the charge ($H \geqq G$), since the multiple-slope covering 1 in accordance with the invention has a depth $M \geqq N$, the depth of the conventional covering 8. To obtain the stage effect of the charge in accordance with the invention, efforts are made to increase each depth $h_3$, $h_2$, $h_1$ of each stage, and in particular the depth $h_1$ of the rear stage, so that $\alpha_1$, the smallest, produces the most rapid jet. However, the advance represented by the charge having a multiple-slope covering in accordance with the invention will be seen by simply examining FIG. 1. An effect resulting from multiple stages is obtained by means of a single covering and a single charge and a single priming means, these replacing the more complicated forms of charges having multiple effects, multiple priming means, multiple coverings, etc.

Also, FIG. 3 shows, by way of example and for the purpose of indicating more clearly the advantages of the multiple-slope covering of the invention, a hollow charge of the first generation having a double-slope covering (or "tulip") and a central priming means.

Generally speaking, it has the same longitudinal dimensions as a conventional modern charge (FIG. 2): $B'=B$, and $G'=G$.

This charge, shown in FIG. 3, consists of a case 12, a main explosive 15, a central priming means 16, a cap 13 and a double-slope covering 14 having a depth N' (angle $\beta_1$ at the top, and $\beta_2 \geqq \beta_1$ at the base, the two slopes being interconnected by a radiused portion).

The initiation means O sets up an arcuate wave P''.

The thickness g' of the covering generally varies progressively.

It will thus be seen that with central arcuate wave P'', the charge incorporating a double-slope covering 14 sets up a rapid jet at the top, this being much more rapid than the heavier jet at the base, so that there results a shorter discontinuous jet having less effect and less power than the elongated and more continuous and coherent jet obtained with the charge in accordance with the invention, which comprises a multiple-slope covering (the thickness of which preferably decreases).

Figure 4:
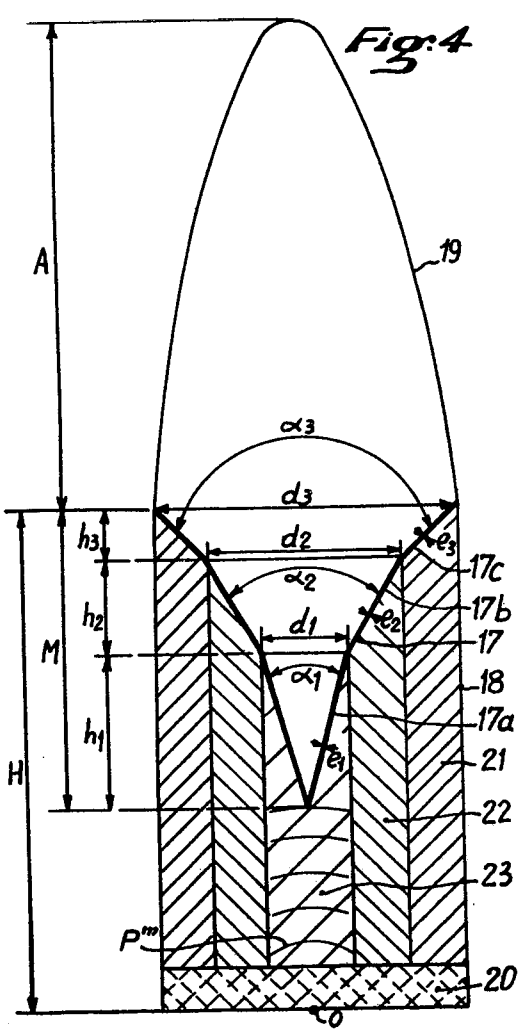

FIG. 4 illustrates a further form of projectile having a multiple-slope covering in accordance with the invention.

The projectile again comprises a covering 17 having three stages of differing slope ($\alpha_1$, $\alpha_2$, $\alpha_3$), a case 18 having a depth H, and a cap 19 defining a lead portion having a length A.

The central priming means 20 again comprises an initiation center 0 producing an arcuate wave P'''.

According to the invention, the charge is formed by coaxial annular layers, each corresponding to a stage of the covering 17:

an annular peripheral layer 21, corresponding to the stage 17*c* having a slope $\alpha_3$;

an intermediate annular layer 22, corresponding to the stage 17*b*, having a slope $\alpha_2 \leqq \alpha_3$; and, a central cylindrical layer 23, corresponding to the stage 17*a*, having a slope $\alpha_1 \leqq \alpha_2 \leqq \alpha_3$.

Furthermore, according to the invention (and in contrast to the principles set forth in the above-mentioned Pat. No. 76 28 964, of Sept. 27, 1976, in the name of the present Applicant), the central layer 23 has a greater detonation velocity (and power) than the intermediate layer 22, and this latter layer, in turn, has a greater detonation velocity (and power) than the peripheral layer 21.

Thus, as a result of the arrangements in accordance with the invention, the detonation wave first impinges upon the central stage or fraction 17*a*, having an angle $\alpha_1$, of the multiple-stage covering 17 of the invention, then the intermediate stage or fraction 17*b*, having an angle $\alpha_2 \geqq \alpha_1$, and finally the exterior stage or fraction 17*c*, having an angle $\alpha_3 \geqq \alpha_2$.

Thus, in accordance with the invention and as indicated above, there is obtained a succession of jets of diminishing rapidity and of the greatest possible continuity: namely, first the jet resulting from $\alpha_1$, then the jet resulting from $\alpha_2$, and finally the jet resulting from $\alpha_3$. Overall, an elongation of the jet and an intensified end-effect are achieved.

Still within the framework of the invention, this form of heterogeneous charge comprising coaxial annular layers can be combined with the varying (diminishing) thicknesses indicated above: $e_1 \geqq e_2 \geqq e_3$, corresponding to the three slopes $\alpha_1 \leqq \alpha_2 \leqq \alpha_3$ of the three stages of the covering 17.

Figure 5:
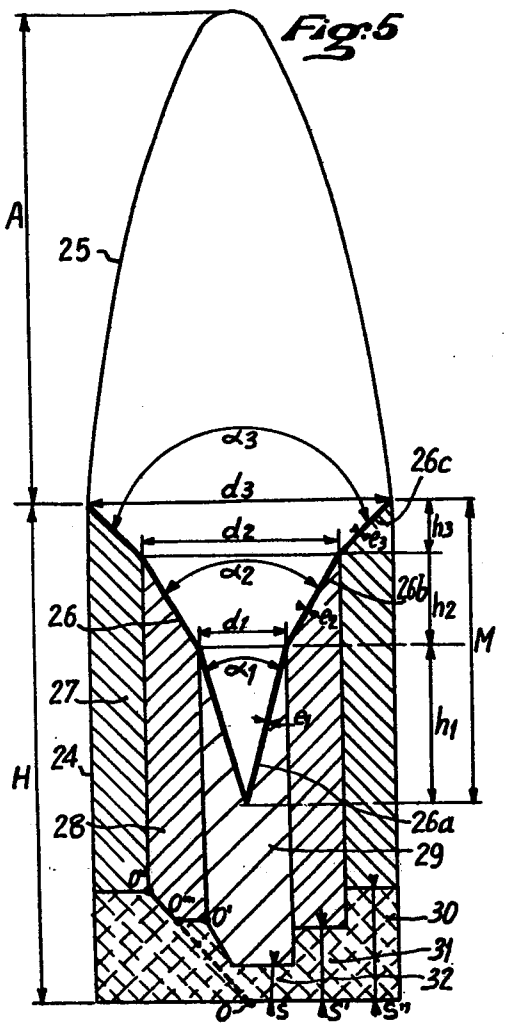

By way of a non-limiting example, FIG. 5 illustrates a projectile having a hollow charge in accordance with the invention, and similar to that of FIG. 4 previously described. In the FIG. 5 arrangement, the priming means of FIG. 4, which is in the form of a disc, is replaced by a stepped priming means, the thickness of which increases from its axis to its periphery for the purpose of increasing the effectiveness of the annular peripheral and intermediate explosives, which act more slowly and are generally less powerful.

FIG. 5 thus shows a projectile case 24 with a cap 25 and a covering 26 comprising three slopes 26*a*, 26*b* and 26*c*, the charge being provided in three layers:

layer 27, which is an outer peripheral annular layer which acts less rapidly and is less powerful and corresponds to the stage or fraction 26*c*, having a slope $\alpha_3$, of the covering in accordance with the invention (sharpest slope);

layer 28, which is the annular intermediate layer, of greater rapidity and power, and which corresponds to the stage or fraction 26*b* having a slope $\alpha_2 \leqq \alpha_3$ of the covering; and, layer 29, which is a central cylindrical layer of still greater rapidity and power, and corresponds to the stage or fraction 26*c* having a slope $\alpha_1 \leqq \alpha_2 \leqq \alpha_3$, of the covering in accordance with the invention.

The half-section, on the right of FIG. 5, illustrates a priming means in the form of a stepped disc and suitable for this type of charge:

external portion 30, having a greater depth s'' for efficiently priming the less powerful peripheral explosive 27;

intermediate portion 31, having a depth $s' \leqq s''$; and, central portion 32, having a depth $s \leqq s' \leqq s''$, for priming the more powerful central explosive 29.

The half-section on the left, in FIG. 5, illustrates an adaptation of the arrangement on the right and shows a modified form adapted to the radial propagation of the detonation wave.

The central initiation point 0 radiates along the straight line 00' through the central layer 29, so that a conical form results.

The center 0 radiates along the straight line 00'' through the intermediate layer 28, so that a frusto-conical form 0'–0'''–0'' results. The depths of the layers remain at $s \leqq s' \leqq s''$.

Figure 6:
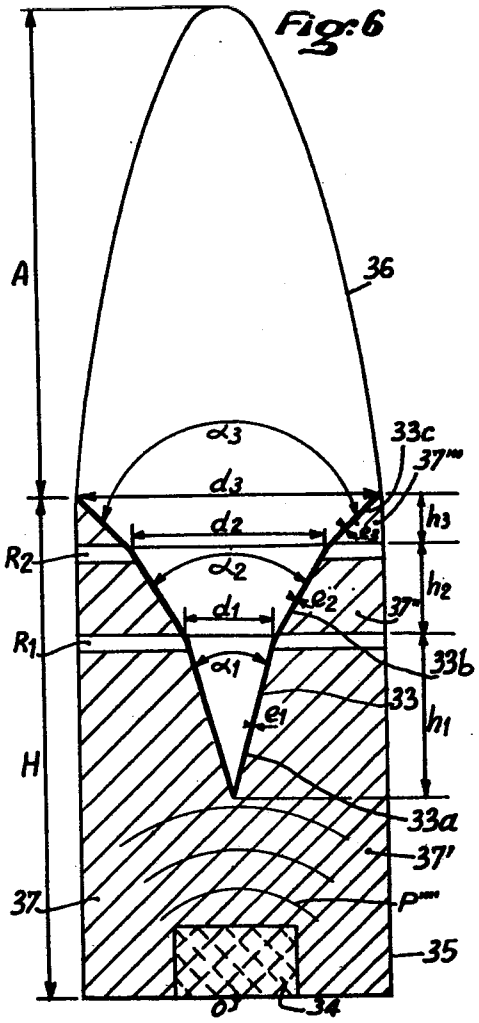

FIG. 6 illustrates a further form of projectile in accordance with the invention and having a triple-stage covering 33, i.e. stage 33*a* having a slope $\alpha_1$, stage 33*b* having a slope $\alpha_2$, and stage 33*c* having a slope $\alpha_3$($\alpha_1 \leqq \alpha_2 \leqq \alpha_3$), with $d_3 \geqq d_2 \geqq d_1$.

The priming means is always located centrally at 34 (wave P''''). The case 35 and the cap 36 complete the construction.

The main charge 2 (FIG. 1) is homogeneous. However, according to the invention, it may also be homogeneous (37) in successive transverse layers, as shown in FIG. 6. According to the invention, in this example and for the purpose of obtaining a continuous succession of jets, emanating first from the stage 33*a*, having a slope $\alpha_1$, then the stage 33*b*, having a slope $\alpha_2$, and finally the stage 33*c*, having a slope $\alpha_3$, there is interposed, between the explosive 37', corresponding to the rear fraction or stage 33*a* of the covering 33, and the explosive 37'', corresponding to the intermediate fraction or stage 33*b* of the same covering, a transverse layer $R_1$ of an explosive having a less rapid action or a pyrotechnical lag, which enables the jet corresponding to the stage 33*b*, having a slope $\alpha_2$, to arrive after that of the jet of the stage 33*a*, having a slope $\alpha_1$.

In the same way, an explosive having a slower effect (or a pyrotechnical lag) forms a transverse layer $R_2$ disposed between the explosives 37'' and 37''', so that the jet emanating from the stage 33*c*, having a slope $\alpha_3$, is caused to arrive after the jet from the stage 33*b*, having a slope $\alpha_2$.

Still within the framework of the invention, this arrangement can be combined with diminishing thicknesses $e_1 \geqq e_2 \geqq e_3$ of covering 33.

Still within the framework of the invention, the transverse layers $R_1$, $R_2$, etc., can be located between different explosives, namely: 37', which is more rapid in effect and more powerful than 37'', and 37'', which is more rapid in effect and more powerful than 37''', etc.

Thus, these layers of explosive 37, 37'' and 37''', which diminish as regards the rapidity of their effect and are less powerful from rear to front, as viewed in FIG. 6, may, still within the ambit of the invention, be combined with the slower-acting transverse layers $R_1$, $R_2$, etc.

I claim:

1. In a hollow charge of the type including a main explosive charge, a priming charge at a rear portion of said main explosive charge, and covering at a forward end of said main explosive charge, said covering having a longitudinal axis, the improvement wherein said covering comprises:

plural covering stages disposed sequentially from a rear end to a forward end of said covering;

each said stage having a conical configuration which converges toward said rear end of said covering and which defines with a plane extending longitudinally through said axis a pair of rectilinear slopes converging toward said rear end of said covering;

the apical angles defined by said pairs of rectilinear slopes increasing from said rear end of said covering to said forward end thereof; and rectilinear extensions of said slopes of adjacent said stages intersecting.

2. The improvement claimed in claim 1, comprising at least three said stages.

3. The improvement claimed in claim 1, wherein the thickness of said entire covering is constant.

4. The improvement claimed in claim 1, wherein the thickness of said stages decrease sequentially from said rear end to said forward end of said covering.

5. The improvement claimed in claim 4, wherein the thickness of each said stage is constant.

6. The improvement claimed in claim 4, wherein the thickness of each said stage decreases from the rear end to the forward end thereof.

7. The improvement claimed in claim 1, wherein said priming charge is positioned centrally of said rear portion of said main explosive charge for producing arcuate waves upon detonation.

8. The improvement claimed in claim 1, wherein said main explosive charge comprises a central cylindrical layer and annular layers coaxially surrounding said cylindrical layer, said annular and cylindrical layers being disposed coaxially with respect to said axis of said covering and axially aligned with respective said stages.

9. The improvement claimed in claim 8, wherein the velocity of detonation of said layers decreases radially outwardly.

10. The improvement claimed in claim 8, wherein the power of the explosives of said layers decreases radially outwardly.

11. The improvement claimed in claim 8, wherein the thickness of said stages decrease sequentially from said rear end to said forward end of said covering.

12. The improvement claimed in claim 7, wherein said priming charge comprises a disc-shaped member extending across rear ends of said cylindrical and annular layers.

13. The improvement claimed in claim 12, wherein said disc-shaped member is radially stepped to define plural annular portions the thickness of which increase radially outwardly, said plural annular portions being axially aligned with respective said layers.

14. The improvement claimed in claim 13, wherein the steps between said plural annular portions are axially continuous.

15. The improvement claimed in claim 13, wherein the steps between said plural annular portions are frusto-conical in configuration.

16. The improvement claimed in claim 1, wherein said main explosive charge comprises plural charge stages corresponding to respective said stages of said covering, and further comprising transversely extending pyrotechnical lagging layers positioned between adjacent said charge stages.

17. The improvement claimed in claim 16, wherein said charge stages have identical explosive properties.

18. The improvement claimed in claim 16, wherein said charge stages have different explosive properties such that the detonation power and velocity decrease from the rear end to the forward end of said main explosive charge.

* * * * *